US005630236A

United States Patent [19]

Messin

[11] Patent Number: 5,630,236

[45] Date of Patent: May 20, 1997

[54] LAVORATORY ASSISTANCE DEVICE

[75] Inventor: Claude Messin, Dampierre-En-Yvelines, France

[73] Assignee: Messin Brevets, Dampierre-En-Yvelines, France

[21] Appl. No.: 648,290

[22] Filed: May 15, 1996

Related U.S. Application Data

[63] Continuation of Ser. No. 356,212, Dec. 14, 1994, abandoned.

[30] Foreign Application Priority Data

Jun. 16, 1992 [FR] France ..... 92 07253

[51] Int. Cl.[6] ..... A47K 13/10

[52] U.S. Cl. ..... 4/667; 4/254; 297/DIG. 10

[58] Field of Search ..... 4/254, 667; 297/DIG. 10; 5/81.1; 414/921

[56] References Cited

U.S. PATENT DOCUMENTS

| | | | |
|---|---|---|---|
| 3,189,345 | 6/1965 | Simpson | 297/DIG. 10 X |
| 3,714,672 | 2/1973 | Condon . | |
| 3,925,833 | 12/1975 | Hunter | 4/667 |
| 4,031,576 | 6/1977 | Epstein . | |
| 4,993,085 | 2/1991 | Gibbons | 4/667 |
| 5,022,106 | 6/1991 | Richards | 4/254 X |
| 5,265,689 | 11/1993 | Kauffman | 5/81.1 X |
| 5,365,621 | 11/1994 | Blain | 5/81.1 |

FOREIGN PATENT DOCUMENTS

| | | | |
|---|---|---|---|
| 1288092 | 9/1991 | Canada | 4/667 |
| 0077269 | 4/1983 | European Pat. Off. . | |
| 1481626 | 10/1967 | France . | |
| 2337547 | 5/1977 | France . | |

*Primary Examiner*—Charles E. Phillips
*Attorney, Agent, or Firm*—Young & Thompson

[57] ABSTRACT

Lavatory assistance device for supporting and assisting persons having difficulty in sitting or standing. A stationary frame (5) is maintained in place by two jack-screws (29) pressing on the ceiling. Two moving connecting rods (25, 26) actuated by a cylinder (2), shift a cradle (20) supporting the user under the armpits. The user controls the lowering, stopping or raising manoeuvre by operating a control having handles (9) which are placed in front of the cradle. The force necessary for these manoeuvres is provided by pressure of water from the main supply acting on the cylinder piston (2) before falling again into the cistern for normal use. The hydraulic connection is made by fitting a special joint (17) in place of the existing tap. The arm-cradle assembly can be folded and blocked in a high position, for normal access to the lavatory. The device can be used in hospitals, homes for the elderly or the sick, rehabilitation centers, or it can be rented out.

21 Claims, 3 Drawing Sheets

LAVORATORY ASSISTANCE DEVICE

This application is a continuation of application Ser. No. 08/356,212, filed Dec. 14, 1994, now abandoned.

FIELD OF THE INVENTION

The invention relates to an assistance device for persons having difficulties in sitting and standing, in particular for sanitary use.

BACKGROUND OF THE INVENTION

In particular, such a device is known from GB-A-2140773 comprising a frame, a cradle comprising a backrest to which arms are connected which are engageable under the armpits to support the handicapped person by the armpits during the entire movement between the standing and seated position and the reverse movement, a mechanism linking the cradle to the frame in a movable manner to guide the cradle between a "standing person" position and a "seated person" position, following a trajectory inclined downwards and to the rear relative to the user and a motor means for actuating the mechanism.

The cradle comprises a backrest and two arms presented in the form of a flexible padded sling, and provides support for the persons' back and under the armpits. The cradle is fastened to the mechanism by two rings passing through two hooks.

The raising and lowering mechanism assembly is situated to the front relative to the handicapped person. The known device is therefore particularly cumbersome and unsuitable for sanitary requirements.

The mechanism allows the movement following an inclined trajectory downwards and backwards to be ensured. However, with use of the flexible cradle and its position relative to the mechanism, the handicapped person who is lifted passes through particularly unstable intermediate positions. The user is tilted backwards and seems to be supported only by the cradle, even when the mechanism reaches the end of its travel.

Therefore a third person will have to intervene to place the cradle around the user, to lift him with the device, to help him to stand up without running the risk of falling over, and finally to remove the cradle.

A device is known from U.S. Pat. No. 4,031,576 comprising a frame having a seat and two armrests linked to a motor means. The seat and the armrests are not effective means with which to support a handicapped person in the process of sitting down or standing up. The supports are not guaranteed.

The Patent WO-84/02074 presents a device where a person is supported under the armpits, under the thighs and at the back, but which only lowers or raises the person who remains seated.

The Patent U.S. Pat. No. 4,443,902 presents a device where a person supported under the armpits can sit down and stand up. The trajectory envisaged downwards and to the front is not very ergonomic relative to the natural movement of a person who is seated. In addition, the device is placed in front relative to the handicapped person and is therefore particularly cumbersome.

Devices are known from Patents WO-82/02146 and U.S. Pat. No. 4,509,785 providing effective support for persons by means placed under the armpits. However, these devices are unstable simple suspensions not having a motor mechanism ensuring a precise trajectory.

Furthermore, apparatuses are known from Patents FR-A-1481626, U.S. Pat. No. 3,714,672 and FR-A-2337547 which have a simple mobile seat to move a person from the seated position to the standing position or are capable of lowering and raising a seated person. They include a seat as the sole means of support. In all these devices, the seat is placed in a vertical or very inclined plane when it is in the "standing person" position, and it is therefore ineffective for supporting the person. As a result the person runs the risk of falling down.

Also, apparatuses are known from EP-A-0077269 and U.S. Pat. No. 4,993,085 with an armrest or grip handle, with which the person can support themselves using the strength of their arms. In any case these devices cannot be used by weak persons.

SUMMARY OF THE INVENTION

The aim of the invention is to propose an assistance device which is simple and straightforward while ensuring the handicapped person has both a support, the stability and ergonomics of which are clearly improved and an autonomy in using the device.

According to the invention, the device allowing handicapped persons to effortlessly be seated on a seat, in particular a toilet seat, passing from a standing position to a seated position, and to then stand up again, comprising:

a frame;

a cradle comprising a backrest to which arms are linked capable of engaging under the armpits in order to support the handicapped person by the armpits during the entire movement of the handicapped person between the standing position and the seated position and during the reverse movement;

a mechanism linking the cradle to the frame in a movable manner to guide the cradle between a "standing person" position and a "seated person position", following a trajectory inclined downwards and backwards relative to the user; and a motor means for actuating the mechanism, is characterised in that said mechanism is linked to the backrest, which supports the arms, and in that the mechanism guides the cradle parallel to itself following said trajectory inclined downwards and backwards.

The mechanism connected directly to the backrest provides an effective and stable guidance along the entire length of the movement. Without external assistance, the user presses his shoulders against the backrest and places his armpits on the two arms of the cradle and in this way is completely supported during the movement. By the displacement of the cradle parallel to itself, the support under the armpits retains optimum effectiveness throughout the movement. Therefore, the device according to the invention is simpler and more economical.

Advantageously, on one side at least the cradle engages under the corresponding armpit of the handicapped person via an arm, at the end of which is a means for controlling the motor means, so that this control means is accessible to the hand of the person supported by the cradle. Preferably, there are two arms at the end of each of which is a handle provided with a trigger. On one side the trigger controls the raising of the cradle, while on the other side, the other trigger controls the descent.

BRIEF DESCRIPTION OF THE DRAWINGS

Other characteristics and advantages of the invention will become apparent from the following description, which relates to non-limitative examples.

In the attached drawings.

DESCRIPTION OF THE PREFERRED EMBODIMENTS

Figure 1:
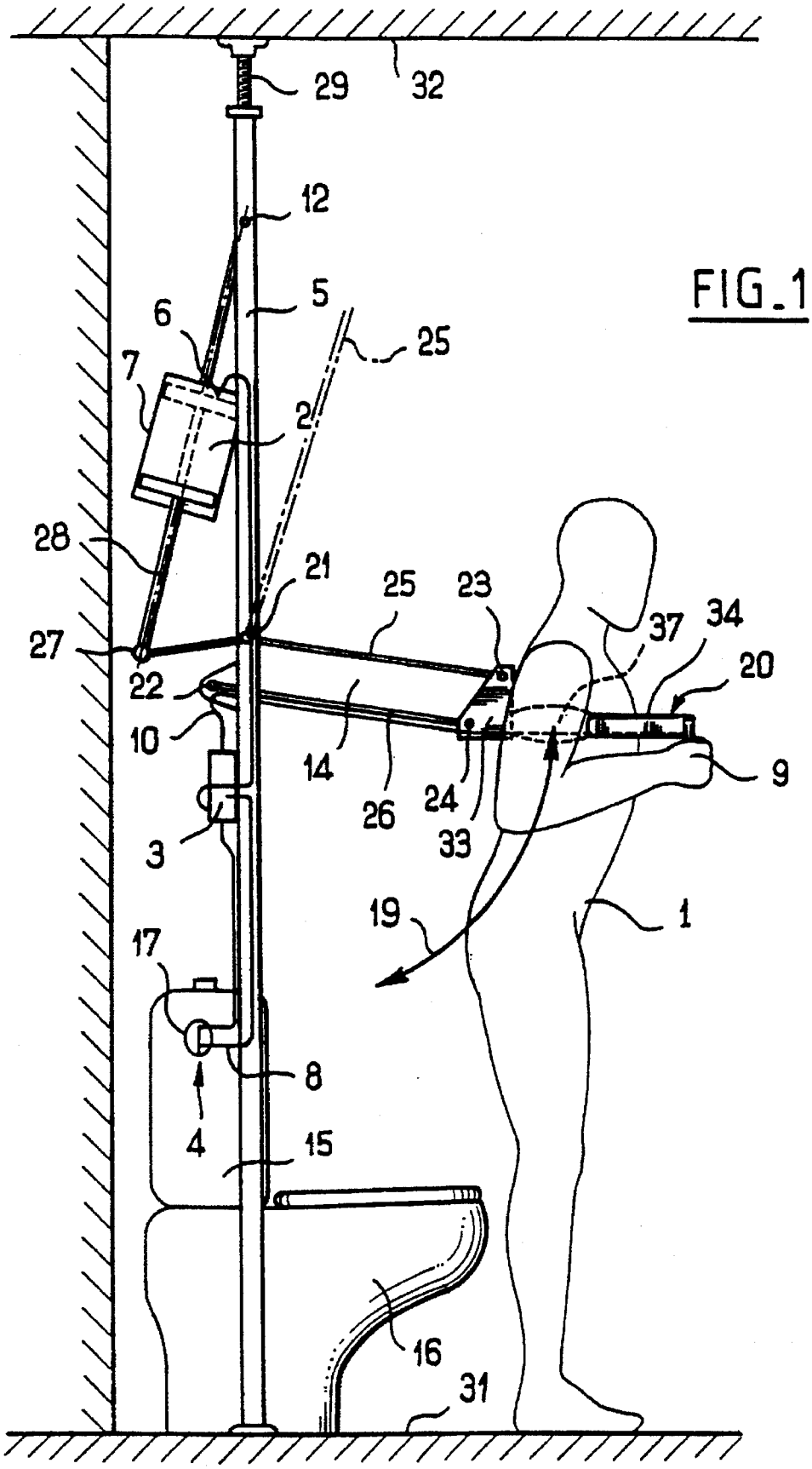
FIGS. 1 and 2 are views of the device according to the invention, in the "standing person" position and "sitting person" position respectively.
Figures 2, 5:
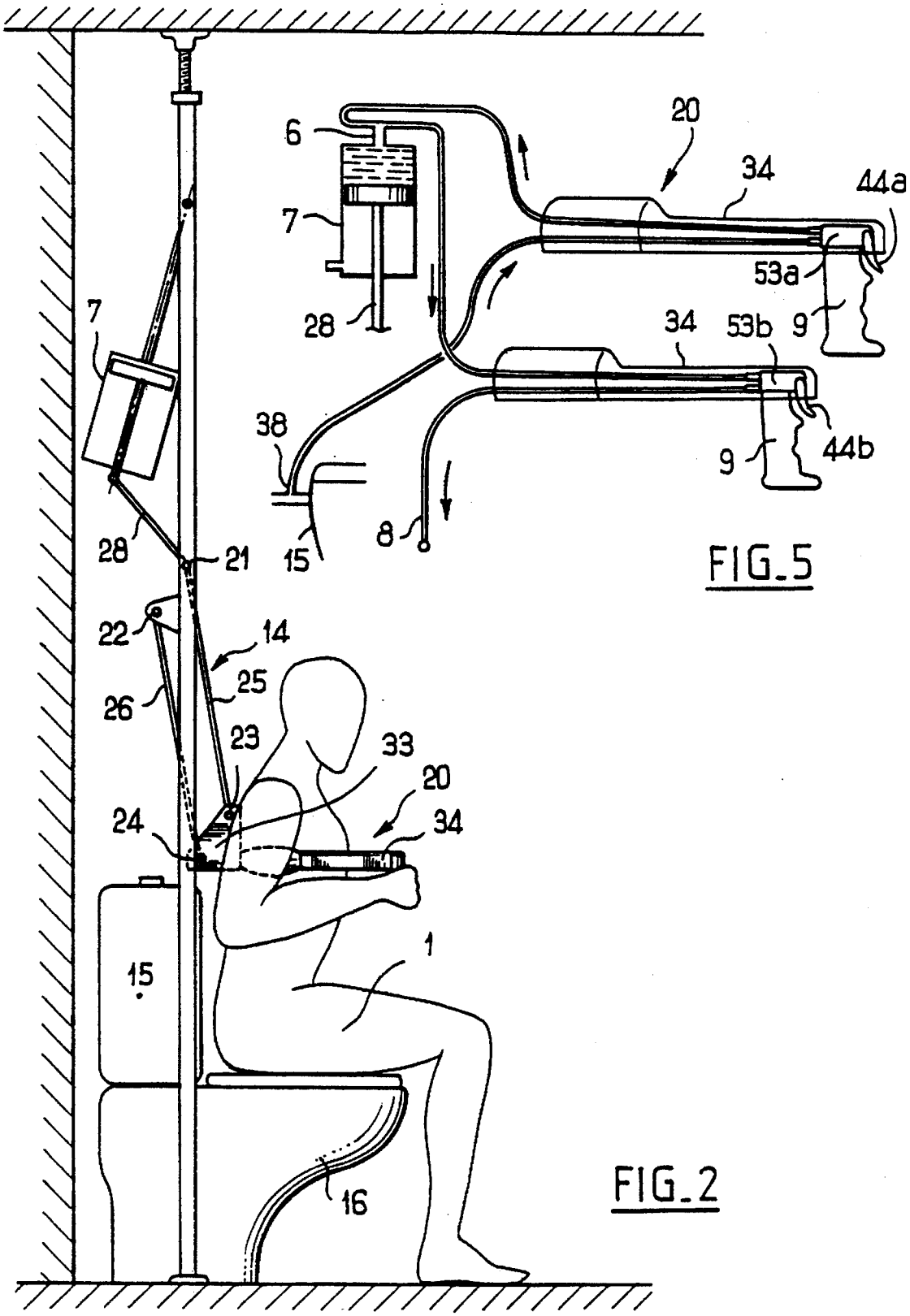
FIG. 5 is a similar view to FIG. 3 but relates to a second embodiment of the cradle.
Figure 3:
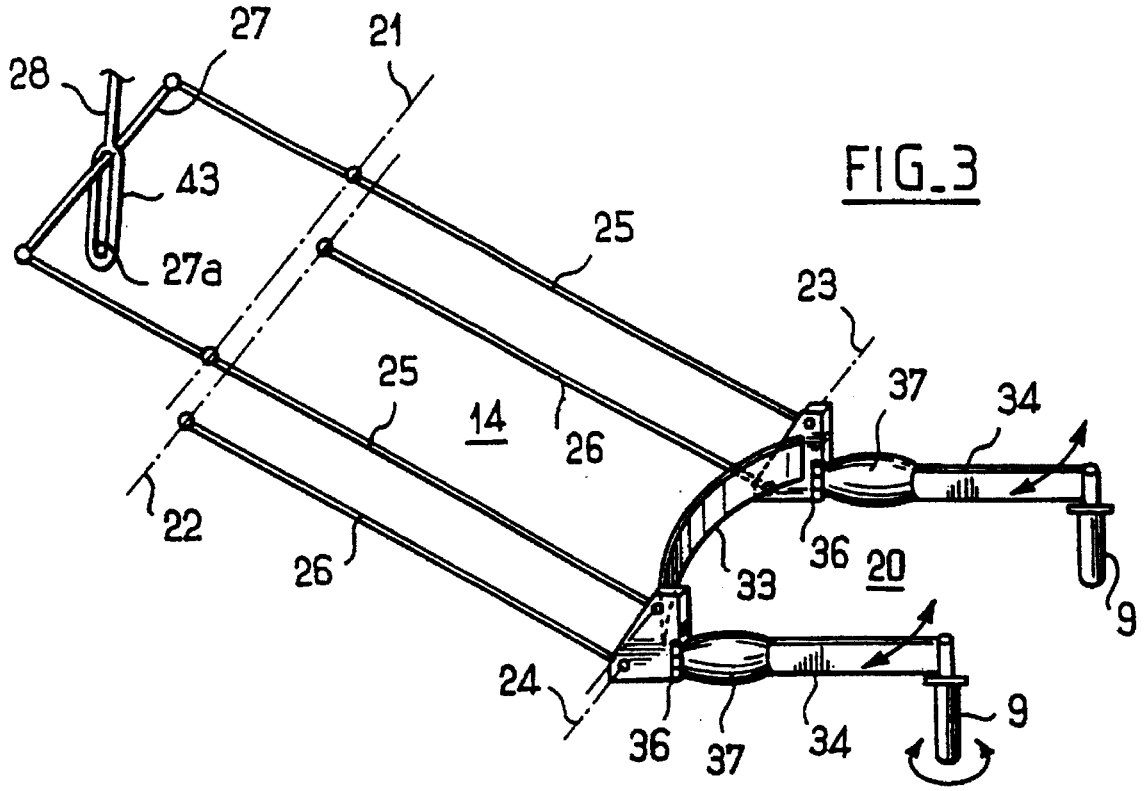
FIG. 3 is a perspective view of a first embodiment of the cradle and the connecting rods which support it.

In the example represented in FIGS. 1 to 3, the device comprises a frame which is essentially constituted by two columns 5 situated on either side of the toilet pan 16. Each column 5 is locked between the floor 31 and the ceiling 32 of the room by means of a jackscrew 29 the adjustable part of which constitutes the upper end of the column.

The columns 5 support in a mobile manner a cradle 20 via a mechanism with the shape of a deformable parallelogram 14.

The cradle 20 comprises a backrest 33 which is linked to the mechanism 14 and to which the arms 34 are articulated by hinges 36 with an approximately vertical axis. Thanks to the mechanism with the shape of a deformable parallelogram which allows the cradle 20 to move parallel to itself relative to the columns 5, the arms 34 of the cradle 20 are permanently situated in an approximately horizontal plane.

As is shown in FIGS. 1 and 2, each of the arms 34 is intended to engage under one of the armpits of the user 1 when the back of the user 1 bears against the backrest 33. The arms 34 comprise pads 37 for the armpits. Each arm 34 ends with a downwardly-directed handle 9, which the user 1 can hold on to. This also allows the user to cause the arms 34 to rotate on the hinges 36 so as to move the arms 34 closer together or further apart as a function of the user's build.

The mechanism 14 comprises, on each side, two connecting rods 25 and 26 one on top of the other, articulated at the corresponding column 5 along axes 21 and 22 respectively and at the backrest 33 along axes 23 and 24 respectively.

In the situation represented in FIG. 1, the device is in a "standing person" position in which the connecting rods 25 and 26 are approximately horizontal while the backrest 33 is above the front edge of the pan 16. Thanks to the mechanism 14, the cradle 20 can move into the "seated person" position represented in FIG. 2, in which the connecting rods 25 and 26 are in an approximately vertical position while the backrest 33 is above the rear edge of the pan 16 and at a lower height than in the "standing person" position.

In this way, the trajectory 19 of the cradle 20 (FIG. 1), is orientated obliquely downwards and towards the rear, relative to the user, in a manner which corresponds in an overall fashion to the movement of the user's shoulders when he or she stands up and sits down.

For the motorization of the mechanism 14, the two connecting rods 25 are extended beyond the axis 21 in order to be linked to one another by a crosspiece 27 to which the end of the rod 28 of a cylinder 2 is articulated. The body 7 of the cylinder 2 is articulated to the columns 5 along an axis 12. A distribution valve 3 allows an exchange port 6 of the cylinder 7 to be selectively connected to the pressure of the mains water distribution system or on the contrary, via an outlet 41, to an outlet pipe 8 opening directly into the cistern 15 of the flushing system. To achieve this, the stopcock at the inlet of the flushing system is replaced by a special joint 17 (FIG. 4 ) containing in addition a T-branch 38 leading to an inlet 39 of the valve 3. Furthermore, the cisterns of flushing systems traditionally have two opposing holes to allow their connection to the mains 4 via the left-hand side or the right-hand side depending on the requirements of the installation. The unused hole is normally blocked with a plug. The invention exploits the presence of this second hole 42 and the outlet pipe 8 is connected to it. If desired the normal adjustment of the float in the water cistern can be modified in order to move the limit level downwards, beyond which limit the supply to the cistern from the mains 4 is interrupted. In this way the contents of the cylinder can be added above the limit level without causing overflowing via the overflow pipe of the cistern.

Figure 4:
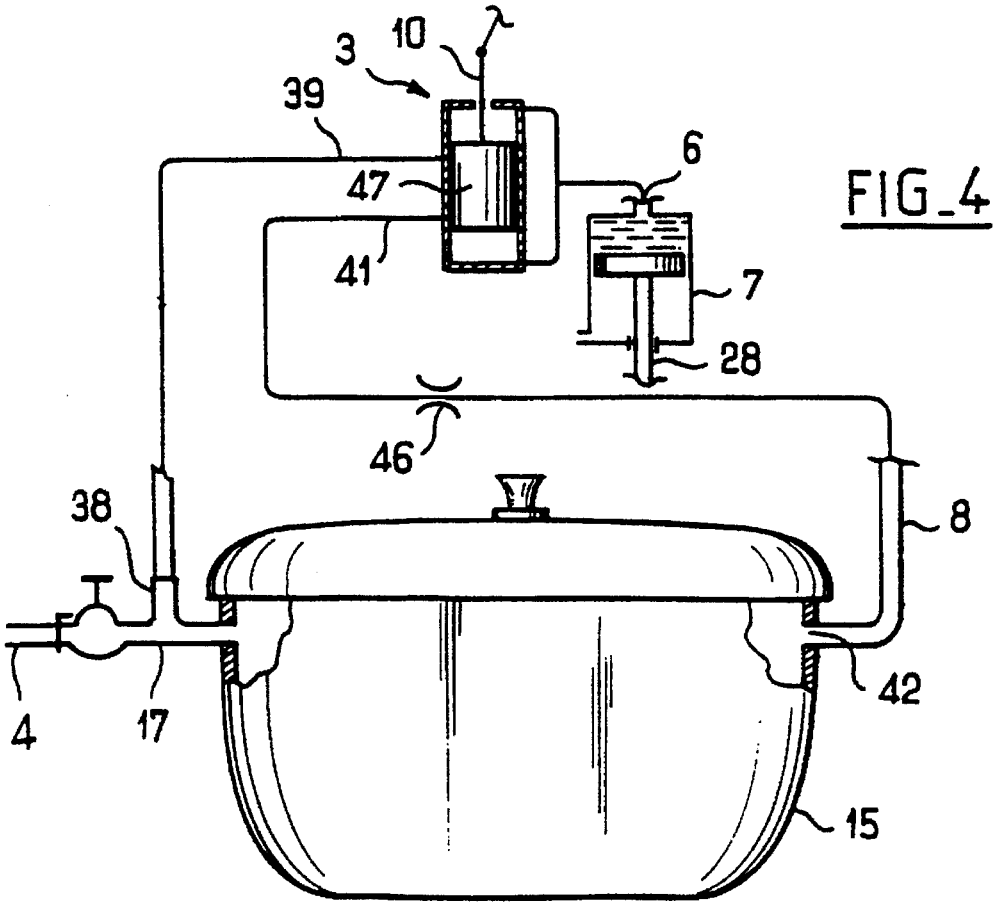
FIG. 4 is a diagram of the hydraulic connections to the cistern of the flushing system.

The distribution valve 3 is of three-position type, one neutral position, represented in FIG. 4, in which the exchange port 6 of the cylinder 7 is isolated, which immobilises the cradle 20. Starting from the neutral position, the mobile slide valve 47 can be displaced downwards in FIG. 4 in order to connect the exchange port 6 with the inlet 39. In this case, the pressure chamber of the cylinder 7 fills up under the pressure of the mains water distribution system 4. This causes the cradle 20 to rise towards the "standing person" position. The slide valve 47 can also be displaced upwards in FIG. 4, in which case the exchange port 6 is connected to the outlet pipe 8 and the cradle 20, in particular when it is subjected to the weight of the user 1 it is supporting, descends towards the "seated person" position. This corresponds to a driving back of liquid into the cistern 15 through the pipe 8. Preferably, the pipe 8 includes a localized or distributed pressure drop 46 which limits the speed of descent. The valve 3 allows the flow rate to be regulated according to whether the sliding valve 47 is more or less displaced from the neutral position.

A control cable 10 (FIG. 1) controls the sliding valve of the valve 3. The cable 10 extends through one of the connecting rods 26 of the mechanism 14 and one of the arms 34 of the cradle 20 to reach one of the handles 9, produced in the form of a twist control handle. Starting from a neutral position, the handle 9 can be twisted in one direction in order to control the descent of the cradle 20 and in the other direction in order to control its rise. Depending on whether the user is right-handed, left-handed or even handicapped in one or other arm, the handle 9 can be linked according to each individual case to the left arm or the right arm of the cradle 20.

As shown in FIG. 3, the articulation between the rod 28 of the cylinder and the crosspiece 27 can be constituted by an oblong opening 43 fixed at the end of the rod 28. This allows the mechanism 14 and the cradle 20 to be folded upwards in a not-in-use position symbolized in FIG. 1 by the position of the connecting rod 25 shown by the dot-and-dash line. The crosspiece 27 then takes up position **27*a* of FIG. 3 in the oblong opening 43. A friction point type locking device can be provided, for example between the crosspiece 27 and the lower end of the oblong opening 43**, to hold the cradle in a removable manner in the high position of non-use.

In the example represented in FIG. 5, the two handles 9 are fixed and each is linked to a trigger **44*a* or 44*b* which depending on how hard it is pressed selectively controls the more or less significant opening of a respective valve 53*a* or 53*b* situated in the end of the corresponding arm 34. The valve 53*a* controls the connection between the T-branch 38 and the exchange port 6 of the cylinder 7, while the valve 53*b*** controls the selective connection between the outlet pipe 8 and the exchange port 6 of the cylinder 7. In this embodiment, the water supply and return pipes respectively to and from the cylinder 7 pass inside the arms 34 of the cradle 20. The valve 3 in FIGS. 1 and 4 is removed. Apart from the foregoing, this embodiment is identical to that of FIGS. 1 to 4.

In order to control the rising movement, the user actuates trigger 44*a* and leaves trigger 44*b* at rest. In order to control the descending movement, the user actuates trigger 44*b* and leaves trigger 44*a* at rest.

This apparatus is particularly intended for hospitals, homes for the elderly or the sick, rehabilitation centre, old people's homes. Its ease of assembly (no requirement to fix it into a wall and no major modification to the plumbing) allows its quick installation in an individual's home. The apparatus is therefore also suitable for equipment rental to handicapped persons.

Of course the invention is not limited to the examples described and represented.

For example, the cradle could be mounted so as to be slidable on a slide, preferably orientated obliquely downwards and towards the rear.

I claim:

1. Device for allowing a handicapped person to be seated effortlessly, wherein the handicapped person passes from a standing to a seated position, and then to a standing position again, comprising:

a frame;

a cradle comprising a backrest and two arms, each arm having one end linked to said backrest and a free end remote from said one end, said arms being capable of engaging under the armpits of said handicapped person in order to support the handicapped person during lowering movement of the handicapped person between the standing position and the seated position, and during raising movement of the handicapped person back from the seated position to the standing position, the free end of each of said arms being connected to a clinging handle permitting the handicapped person to hold on to the clinging handles during lowering and raising movements;

a mechanism linking the cradle to the frame for moving the cradle between a standing position and a seated position, following a trajectory inclined downwards and backwards relative to a user having his back against the backrest; and a motor means for actuating the mechanism, said mechanism being linked to the backrest in such a manner that the arms of the cradle remain in a substantially horizontal plane when the cradle follows said trajectory.

2. Device according to claim 1, wherein the mechanism comprises two connecting rods articulated to the frame and to the cradle.

3. Device according to claim 1, further comprising at least one control means for the motor means, said control means being positioned at the free end of one of said arms, so that said control means is accessible by hand to the person supported by the cradle.

4. Device according to claim 1, wherein each of the arms carries at its free end, a control for one of the respective directions of movement of the cradle between the seated and standing positions.

5. Device according to claim 1, wherein one of the clinging handles is a twist handle for controlling the motor means.

6. Device according to claim 1, wherein each handle is linked to a control trigger of one of the directions of movement of the cradle between the seated and standing positions.

7. Device according to claim 1, wherein the two arms are freely movable relative to the backrest closer together and further apart relative to each other under action of the handicapped person holding the clinging handles.

8. Device according to claim 1, wherein the two arms are connected to the backrest by pivotal means allowing rotation of said arms in a substantially horizontal plane with respect to the backrest.

9. Device for allowing a handicapped person to be seated effortlessly on a toilet seat, wherein the handicapped person passes from a standing to a seated position, and then to a standing position again, comprising:

a frame;

a cradle comprising a backrest and two arms, each arm having one end linked to said backrest and a free end remote from said one end, said arms being capable of engaging under the armpits of said handicapped person in order to support the handicapped person during lowering movement of the handicapped person between the standing position and the seated position, and during raising movement of the handicapped person back from the seated position to the standing position, the free end of each of said arms being connected to a clinging handle permitting the handicapped person to hold on to the clinging handles during lowering and raising movements;

a mechanism linking the cradle to the frame for moving the cradle between a standing position and a seated position, following a trajectory inclined downwards and backwards relative to a user having his back to the toilet seat; and a motor means for actuating the mechanism, said mechanism being linked to the backrest in such a manner that the arms of the cradle remain in a substantially horizontal plane when the cradle follows said trajectory.

10. Device according to claim 9, wherein the two arms are connected to the backrest by pivotal means allowing rotation of said arms in a substantially horizontal plane with respect to the backrest.

11. Device according to claim 9, wherein the two arms are freely movable relative to the backrest closer together and further apart relative to each other under action of the handicapped person holding the clinging handles.

12. Device according to claim 9, wherein the frame is installed on either side of the toilet seat, and is held up by support means which lock against the ceiling.

13. Device according to claim 9, further including means for moving the two arms of the cradle closer together or further apart relative to each other so as to adapt to the build of the handicapped person.

14. Device according to claim 9, wherein the motor means comprise a cylinder linked via at least one control valve and a pipe coupling to a water supply main supplying the toilet cistern and using the pressure of the water supply main for its motive power.

15. Device according to claim 14, further comprising a pipe for evacuating water used by the cylinder, said pipe opening into the toilet cistern independently of the mains distribution system.

16. Device according to claim 14, wherein said pipe coupling is installed as a replacement for an existing stopcock.

17. Device according to claim 9, wherein the mechanism comprises two connecting rods articulated to the frame and to the cradle.

18. Device according to claim 9, further comprising at least one control means for the motor means, said control means being positioned at the said free end of one of said arms, so that said control means is accessible by hand to the person supported by the cradle.

19. Device according to claim 18, wherein each of the arms carries at its free end, a control for one of the respective directions of movement of the cradle between the seated and standing positions.

20. Device according to claim 9, wherein each handle is linked to a control trigger of one of the directions of movement of the cradle between the seated and standing positions.

21. Device according to claim 9, wherein one of the handles is a twist handle for controlling the motor means.

* * * * *